US008153212B2

(12) United States Patent
Hyakuda et al.

(10) Patent No.: US 8,153,212 B2
(45) Date of Patent: Apr. 10, 2012

(54) INK JET RECORDING MEDIUM

(75) Inventors: Hirokazu Hyakuda, Wakayama (JP); Hiroshi Kakihira, Fuji (JP); Hisao Kamo, Ushiku (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/995,017

(22) PCT Filed: May 29, 2009

(86) PCT No.: PCT/JP2009/060297

§ 371 (c)(1),
(2), (4) Date: Nov. 29, 2010

(87) PCT Pub. No.: WO2009/157287

PCT Pub. Date: Dec. 30, 2009

(65) Prior Publication Data

US 2011/0076427 A1 Mar. 31, 2011

(30) Foreign Application Priority Data

Jun. 23, 2008 (JP) ..... 2008-163644

(51) Int. Cl.
*B41M 5/40* (2006.01)

(52) U.S. Cl. ..... 428/32.34; 428/32.35; 428/32.36

(58) Field of Classification Search ..... 428/32.34, 428/32.35, 32.36

See application file for complete search history.

(56) References Cited

U.S. PATENT DOCUMENTS

| | | | |
|---|---|---|---|
| 3,871,982 | A | 3/1975 | Idstein |
| 4,202,870 | A | 5/1980 | Weber et al. |
| 4,242,271 | A | 12/1980 | Weber et al. |
| 4,345,059 | A | 8/1982 | Fretz, Jr. et al. |
| 5,091,009 | A | 2/1992 | Nogami et al. |
| 5,955,185 | A | 9/1999 | Yoshino et al. |
| 5,965,252 | A | 10/1999 | Santo et al. |
| 7,601,779 | B2 | 10/2009 | Hyakuda et al. |
| 7,625,614 | B2 | 12/2009 | Kamo et al. |
| 7,846,516 | B2 | 12/2010 | Kamo et al. |
| 7,867,586 | B2 | 1/2011 | Kamo et al. |
| 2005/0253916 | A1 | 11/2005 | Poncelet et al. |
| 2006/0066707 | A1 | 3/2006 | Poncelet et al. |
| 2007/0093386 | A1 | 4/2007 | Ishikawa et al. |
| 2009/0110828 | A1 | 4/2009 | Nagase et al. |
| 2011/0008553 | A1 | 1/2011 | Hyakuda et al. |

FOREIGN PATENT DOCUMENTS

| | | | |
|---|---|---|---|
| EP | 0 701 904 | A1 | 3/1996 |
| EP | 0 701 904 | B1 | 8/1999 |
| JP | 49-056834 | A | 6/1974 |
| JP | 57-044760 | B2 | 9/1982 |
| JP | 1-317115 | A | 12/1989 |
| JP | 2-258646 | A | 10/1990 |
| JP | 3-013376 | A | 1/1991 |
| JP | 4-039324 | A | 2/1992 |
| JP | 7-232473 | A | 9/1995 |
| JP | 7-232475 | A | 9/1995 |
| JP | 8-132731 | A | 5/1996 |
| JP | 9-066664 | A | 3/1997 |
| JP | 9-076628 | A | 3/1997 |
| JP | 2803134 | B2 | 9/1998 |
| JP | 2881847 | B2 | 4/1999 |
| JP | 2002-219855 | A | 8/2002 |
| JP | 2002-370446 | A | 12/2002 |
| JP | 2003-155453 | A | 5/2003 |
| JP | 2004-188667 | A | 7/2004 |
| JP | 2004-216685 | A | 8/2004 |
| JP | 2005-007828 | A | 1/2005 |
| JP | 2006-123316 | A | 5/2006 |
| WO | 2004/009367 | A1 | 1/2004 |
| WO | 2004/009368 | A1 | 1/2004 |
| WO | 2006/129823 | A1 | 12/2006 |

OTHER PUBLICATIONS

Apr. 27, 2011 European Search Report in European Patent Application No. 09769997.9.

Jan. 13, 2011 International Preliminary Report on Patentability and Jul. 28, 2009 Written Opinion in International Patent Application No. PCT/JP2009/060297.

Jul. 28, 2009 International Search Report and Written Opinion in International Application No. PCT/JP2009/060297.

Nov. 30, 2011 Official Action in Chinese Patent Appln. No. 200980122891.5.

*Primary Examiner* — Betelhem Shewareged

(74) *Attorney, Agent, or Firm* — Fitzpatrick, Cella, Harper & Scinto

(57) ABSTRACT

The invention provides an ink jet recording medium excellent in light fastness, gas fastness and uniform ink absorption. The ink jet recording medium has a substrate and an ink receiving layer provided on at least one surface of the substrate. The ink receiving layer contains a compound represented by the general formula (1):

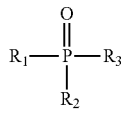

(1)

wherein $R_1$, $R_2$ and $R_3$ are individually a linear or branched alkyl group having 1 to 20 carbon atoms, with the proviso that at least one of $R_1$, $R_2$ and $R_3$ has a hydroxyl group.

3 Claims, No Drawings

INK JET RECORDING MEDIUM

TECHNICAL FIELD

The present invention relates to an ink jet recording medium.

BACKGROUND ART

There is a demand for outputting by an ink jet recording system recorded images comparable in fixability and coloring ability with silver salt photographs or with recorded images obtained by multi-color printing of a plate making system. In order to meet such a demand, a wide variety of recording media has been proposed as ink jet recording media used in the ink jet recording system. For example, an ink jet recoding medium containing an alumina hydrate as a component of an ink receiving layer has been proposed (see Japanese Patent Application Laid-Open No. H07-232475 (Patent Art. 1)).

In recent years, recorded image formed on ink jet recording media have been required to have good light fastness and gas fastness. Thus, an ink jet recording medium containing a hindered amine compound as an image fading preventing agent for improving light fastness and gas fastness has been proposed (see Japanese Patent Application Laid-Open No. H03-013376 (Patent Art. 2)). An ink jet recording medium containing a pentavalent phosphoric acid derivative has also been proposed (see Japanese Patent Application Laid-Open No. 2004-188667 (Patent Art. 3)). An ink jet recording medium containing a pentavalent phosphate compound has been further proposed (see Japanese Patent Application Laid-Open No. 2006-123316 (Patent Art. 4)).

DISCLOSURE OF THE INVENTION

However, the ink jet recording media described in Patent Arts. 1 to 3 are required to more improve light fastness, gas fastness and uniform ink absorption. The phosphate compound contained in the ink jet recording medium described in Patent Art. 4 involves a problem of hydrolyzing tendency, and image density of a recorded image formed on the ink jet recording medium is lowered when water is used in formation of an ink receiving layer. Thus, an organic solvent is required when the phosphate compound is contained in the ink receiving layer.

It is accordingly an object of the present invention to provide an ink jet recording medium having such high light fastness, gas fastness and uniform ink absorption as demanded in recent years.

The present inventors have carried out a detailed investigation with a view toward solving the above problems to find the following invention.

The present invention provides an ink jet recording medium comprising a substrate and an ink receiving layer provided on at least one surface of the substrate, wherein the ink receiving layer contains a compound represented by the following general formula (1):

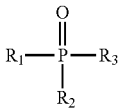

(1)

wherein $R_1$, $R_2$ and $R_3$ are individually a linear or branched alkyl group having 1 to 20 carbon atoms, with the proviso that at least one of $R_1$, $R_2$ and $R_3$ has a hydroxyl group.

According to the present invention, an ink jet recording medium having such high light fastness, gas fastness and uniform ink absorption as demanded in recent years can be provided.

BEST MODE FOR CARRYING OUT THE INVENTION

The ink jet recording medium according to the present invention will hereinafter be described in detail.

The ink jet recording medium according to the present invention has a substrate and an ink receiving layer provided on at least one surface of the substrate. The ink receiving layer contains a compound represented by the following general formula (1):

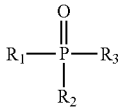

(1)

wherein $R_1$, $R_2$ and $R_3$ are individually a linear or branched alkyl group having 1 to 20 carbon atoms, with the proviso that at least one of $R_1$, $R_2$ and $R_3$ has a hydroxyl group.

The compound represented by the general formula (1) serves as an image fading preventing agent in the ink jet recording medium and the weatherability of the resulting recorded image, such as light fastness and gas resistance, is improved. The reason why the compound represented by the general formula (1) serves as an image fading preventing agent in the ink jet recording medium, and the weatherability of the resulting recorded image is improved is not clearly known. However, the present inventors consider the reason to be in virtue of such a mechanism as described below. The compound represented by the general formula (1) has high quenching ability against a singlet oxygen generated in a molecule of a dye or pigment, which is a component of an ink, by irradiation of xenon or the like. This is considered to be attributable to the situation that the P—C linkage in the compound represented by the general formula (1) has high singlet oxygen quenching ability compared with the P—O linkage and the P—S linkage. As a result, the ink jet recording medium containing the compound represented by the general formula (1) more improves the weatherability of a resulting recorded image than an ink jet recording medium containing a phosphate compound.

The ink jet recording medium containing the compound represented by the general formula (1) is also good in uniformity of ink absorption.

The structure of the compound represented by the general formula (1) will hereinafter be described in detail. However, The compound represented by the general formula (1) according to the present invention is not limited thereto.

At least one of $R_1$, $R_2$ and $R_3$ in the general formula (1) has a hydroxyl group, whereby the compound represented by the general formula (1) becomes highly water-soluble and can be added into an aqueous coating liquid for ink jet receiving layers, so that it is contained in an ink receiving layer.

Pentavalent phosphate compounds having a solubilizing group such as —COOM or —$SO_3M$ (M denotes a hydrogen atom or metal atom) have heretofore been proposed. These compounds are water-soluble and can be added into an aqueous ink jet coating liquid. However, when these compounds are added into an aqueous coating liquid for ink jet receiving layers to form a receiving layer of a recording medium, the pH of the surface of the recording medium is lowered, and so the ink absorbency of the recording medium and the dispersibility of pigments may be deteriorated in some cases to deteriorate the image quality of a resulting recorded image.

On the contrary, the hydroxyl group substituted on $R_1$, $R_2$ or $R_3$ in the compound represented by the general formula (1) is a neutral solubilizing group and has less harmful influences on such ink absorbency and image quality as described above.

The compound represented by the general formula (1) can be produced according to the publicly known process shown in Japanese Patent Application Laid-Open No. 4-39324, which is conducted industrially. As a specific process, an alkylphosphine is first obtained by a radical addition reaction of phosphine to various olefins in the presence of an azobis type radical catalyst such as azoisobutyronitrile. Thereafter, the alkylphosphine is oxidized with hydrogen peroxide, thereby being converted to its corresponding phosphine oxide to produce a compound represented by the general formula (1). For example, tris-hydroxypropylphosphine oxide is produced by reacting allyl alcohol with phosphine in the presence of an azobis type radical catalyst and oxidizing tris-hydroxypropylphosphine thus obtained with hydrogen peroxide.

Favorable specific examples of the compound represented by the general formula (1) are mentioned below. However, the compound is not limited thereto. The examples thereof include dimethylhydroxymethylphosphine oxide, dimethylhydroxyethylphosphine oxide, diethylhydroxypropyl-phosphine oxide, ethyl-bis(3-hydroxyethyl)phosphine oxide, ethyl-bis(3-hydroxypropyl)phosphine oxide, tris-3-hydroxymethylphosphine oxide, tris-2-hydroxyethylphosphine oxide, tris-3-hydroxypropylphosphine oxide, tris-4-hydroxybutylphosphine oxide, tris-3-hydroxybutylphosphine oxide, tris-hydroxypentylphosphine oxide, tris-hydroxyhexylphosphine oxide and n-butyl-bis(3-hydroxypropyl)phosphine oxide. Among these compounds, tris-n-butylphosphine oxide, tris-3-hydroxypropylphosphine oxide, tris-4-hydroxybutylphosphine oxide, tris-3-hydroxybutylphosphine oxide and n-butyl-bis(3-hydroxypropyl)phosphine oxide are favorable from the viewpoints of phosphorus content in the compound and easy availability. Further, tris-3-hydroxy-propylphosphine oxide, tris-4-hydroxybutylphosphine oxide and tris-3-hydroxybutylphosphine oxide are particularly favorable from the viewpoint of the fact that the phosphorus compounds exhibit high water-solubility and can be easily added into an aqueous coating liquid for ink jet receiving layers.

Among the above-described compounds, the structures of four kinds of compounds are shown below.

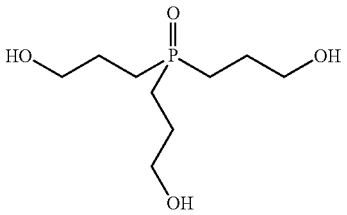

(Tris-3-hydroxypropylphosphine oxide)

-continued

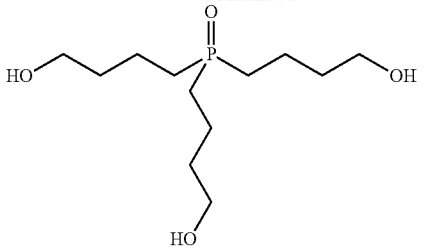

(Tris-4-hydroxybutylphosphine oxide)

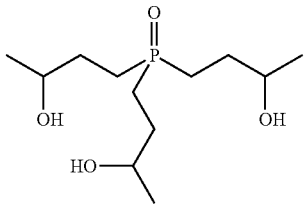

(Tris-3-hydroxybutylphosphine oxide)

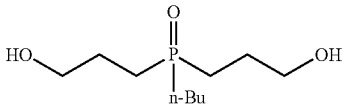

(n-Butyl-bis(3-hydroxypropyl)phosphine oxide)

As a process for causing a compound represented by the general formula (1) to be contained in an ink receiving layer, may be mentioned, for example, the following processes:

(a) A process in which the compound represented by the general formula (1) is added into a dispersion of fine particles such as pigment particles, and this dispersion is then applied on to a substrate and dried to form an ink receiving layer;

(b) A process in which an ink receiving layer is formed in advance, a coating liquid containing a compound represented by the general formula (1) is applied on to the ink receiving layer to cause the compound represented by the general formula (1) to be penetrated and contained in the ink receiving layer.

The process (a) is favorable as the process for causing the compound represented by the general formula (1) to be contained in the substrate or ink receiving layer for reasons of easy production.

The ink receiving layer of the ink jet recording medium according to the present invention favorably contains a pigment and a binder in addition to the compound represented by the general formula (1). As the pigment, may be used an inorganic pigment or organic pigment.

As examples of the inorganic pigment, may be mentioned precipitated calcium carbonate, heavy calcium carbonate, magnesium carbonate, kaolin, aluminum silicate, diatomaceous earth, calcium silicate, magnesium silicate, synthetic amorphous silica, colloidal silica, alumina, alumina hydrate and magnesium hydroxide.

As examples of the organic pigment, may be mentioned styrenic plastic pigments, acrylic plastic pigments, polyethylene particles, microcapsule particles, urea resin particles and melamine resin particles.

As the pigment, one may be chosen for use from these pigments, or two or more pigments may be used in combination as needed. Among these pigments, inorganic pigments are favorably used from the viewpoints of ink absorbency, dye fixability, transparency, optical density, coloring ability and glossiness. Among the inorganic pigments, alumina hydrate and silica are favorably used, and alumina hydrate is particularly favorably used. The reason for it is that the alumina hydrate itself has high dye fixing ability as a pigment, there is no need of separately adding a dye fixing agent in plenty like silica, and the alumina hydrate can achieve high pore volume and ink absorption by itself.

The average particle size of the pigment is favorably 1 mm or less. Fine silica particles or alumina type hydrates such as alumina and alumina hydrate having an average particle size of 1 mm or less are favorable from the viewpoints of transparency and glossiness. Fine silica particles typified by commercially available colloidal silica are favorable as the fine silica particles. Examples of particularly favorable fine silica particles include those disclosed in Japanese Patent Nos. 2803134 and 2881847. Alumina hydrate is favorable as the alumina pigment. The alumina hydrate is represented by the following general formula (2):

$$Al_2O_{3-n}(OH)_{2n}.mH_2O$$

wherein n is any one of 1, 2 and 3, and m is a value falling within a range of from 0 to 10, favorably from 0 to 5, with the proviso that m and n are not 0 at the same time. In many cases, $mH_2O$ represents an aqueous phase, which does not participate in the formation of a crystal lattice, but is able to be eliminated. Therefore, m may take a value of an integer or a value other than the integer. When this kind of material is heated, m may reach a value of 0 in some cases.

The alumina hydrate can be generally produced according to publicly known processes. As examples of specific processes, may be mentioned processes in which an aluminum alkoxide or sodium aluminate is hydrolized (U.S. Pat. Nos. 4,242,271 and 4,202,870). In addition, a process in which an aqueous solution of aluminum sulfate or aluminum chloride is added to an aqueous solution of sodium aluminate to conduct neutralization (Japanese Patent Publication No. S57-44760) may be mentioned.

Among alumina hydrates, alumina hydrate showing a beohmite structure or amorphous structure when analyzed by the X-ray diffractometry is favorable. As such alumina hydrate, alumina hydrates described in Japanese Patent Application Laid-Open Nos. H07-232473, H08-132731, H09-066664 and H09-076628 are particularly favorable.

In the ink receiving layer of the ink jet recording medium, supposing that the content of the compound represented by the general formula (1) is A parts by mass in terms of solid content and the content of the pigment is B parts by mass in terms of solid content, A/B favorably satisfies the relationship $1 \leqq (A/B) \times 100 \leqq 20.0$. In order to obtain good light fastness of the resulting recorded image, the relationship $0.1 \leqq (A/B) \times 100$ is favorable, the relationship $0.2 \leqq (A/B) \times 100$ is more favorable, and the relationship $3.0 \leqq (A/B) \times 100$ is still more favorable. The relationship $(A/B) \times 100 \leqq 20.0$ is favorable because deterioration of uniform ink absorption in the resulting recorded image due to the addition of the image fading preventing agent can be inhibited, and the relationship $(A/B) \times 100 \leqq 6.0$ is more favorable.

Examples of the binder contained in the ink jet recording medium according to the present invention include conventionally known binders, such as polyvinyl alcohol, modified products of polyvinyl alcohol, starch or modified products thereof, gelatin or modified products thereof, casein or modified products thereof, gum arabic, cellulose derivatives such as carboxymethyl cellulose, hydroxyethyl cellulose and hydroxypropylmethyl cellulose, conjugated diene copolymer latexes such as SBR latexes, NBR latexes and methyl methacrylate-butadiene copolymers, functional-group-modified polymer latexes, vinyl copolymer latexes such as ethylene-vinyl acetate copolymers, polyvinyl pyrrolidone, maleic anhydride polymers or copolymers thereof, and acrylic ester copolymers. These binders may be used either singly or in any combination thereof. A water-soluble resin is favorably used as the binder. Among water-soluble resins, polyvinyl alcohol is more favorably used. When the pigment is contained in the ink receiving layer, the content of the binder in the ink receiving layer is favorably controlled to 5 parts by mass or more per 100 parts by mass of the pigment. If the content is less than 5 parts by mass, the resulting receiving layer tends to lower its strength. The content is favorably controlled to 20 parts by mass or less, more favorably 15 parts by mass or less. If the content exceeds 20 parts by mass, the pore volume is lowered to lower the ink absorbency.

One or more boric acid compounds are favorably contained as a crosslinking agent in the ink receiving layer. As examples of boric acid compounds usable in this case, may be mentioned orthoboric acid ($H_3BO_3$), metaboric acid and diboric acid. Salts of boric acid are favorably water-soluble salts of the above-described boric acid compounds. As specific examples thereof, may be mentioned alkali metal salts such as sodium salts ($Na_2B_4O_7.10H_2O$, $NaBO_2.4H_2O$, etc.) and potassium salts ($K_2B_4O_7.5H_2O$, $KBO_2$, etc.) of boric acid, ammonium salts ($NH_4B_4O_9.3H_2O$, $NH_4B_4O_9$, etc.) of boric acid, and alkaline earth metal salts such as magnesium salts and calcium salts of boric acid. Among these compounds, orthoboric acid is favorably used from the viewpoints of stability with time of the resulting coating liquid and an effect of inhibiting the occurrence of cracks.

The boric acid compound is favorably contained in a proportion of 1.0 part by mass or more per 100 parts by weight of the binder in the ink receiving layer. The boric acid compound is also favorably contained in a proportion of 20.0 parts by mass or less, more favorably 15.0 parts by mass or less. The content of the boric acid compound satisfies the above-described conditions, whereby the stability with time of the resulting coating liquid can be improved. Specifically, even when the coating liquid is used over a long period of time upon production, viscosity increase of the coating liquid or occurrence of gelled products is inhibited. As a result, replacement of the coating liquid or cleaning of a coater head is not required, so that productivity can be improved. Incidentally, when production conditions are more suitably selected, occurrence of cracks can be more effectively prevented.

In order to make ink absorbency and fixability good, the ink receiving layer favorably has pore physical properties satisfying the following conditions:

(1) The pore volume of the ink receiving layer is favorably within a range of from 0.1 $cm^3/g$ or more to 1.0 $cm^3/g$ or less. When the pore volume of the ink receiving layer is 0.1 $cm^3/g$ or more, sufficient ink-absorbing performance is achieved, and an ink receiving layer excellent in ink absorbency can be provided. When the pore volume of the ink receiving layer is 1.0 $cm^3/g$ or less, ink overflowing or image bleeding can be prevented, and moreover cracking and powdery coming-off can be inhibited.

(2) The BET specific surface area of the ink receiving layer is favorably 20 $m^2/g$ or more and 450 $m^2/g$ or less. When the BET specific surface area of the ink receiving layer is 20 $m^2/g$ or more, sufficient glossiness is achieved, and transparency is improved. In addition, the ability to adsorb a dye in an ink is improved. When the BET specific surface area of the ink receiving layer is 450 $m^2/g$ or less, such an ink receiving layer becomes hard to cause cracking. Incidentally, the values of the pore volume and BET specific surface area can be determined by the nitrogen adsorption and desorption method.

To the ink receiving layer, other additives than the compound represented by the general formula (1) may also be added as needed. Examples of the other additives include dispersants, thickeners, pH adjustors, lubricants, flowability modifiers, surfactants, antifoaming agents, parting agents, optical whitening agents, ultraviolet light absorbers and antioxidants.

The dry coating amount of the ink receiving layer is favorably controlled to 30 g/m$^2$ or more and 60 g/m$^2$ or less. When the dry coating amount of the ink receiving layer is 30 g/m$^2$ or more, sufficient ink absorbency is achieved, and so it is prevented to cause ink overflowing to cause bleeding. In addition, an ink receiving layer having sufficient ink absorbency under a high-temperature and high-humidity environment can be provided. In particular, this tendency becomes marked when the resulting recording medium is used for a printer in which a black ink and a plurality of light shade inks are used in addition to three color inks of cyan, magenta and yellow. When the dry coating amount of the ink receiving layer is 60 g/m$^2$ or less, the occurrence of cracking can be prevented. In addition, the resulting ink receiving layer becomes hard to cause coating unevenness, whereby an ink receiving layer having a stable thickness can be produced.

As the substrate used in the ink jet recording medium according to the present invention, may favorably be used a substrate made of, for example, a film, cast-coated paper, baryta paper or resin-coated paper (resin-coated paper obtained by coating both surfaces thereof with a resin such as a polyolefin). Example of the film used in the substrate include transparent films of the following thermoplastics: polyethylene, polypropylene, polyester, polylactic acid, polystyrene, polyacetate, polyvinyl chloride, cellulose acetate, polyethylene terephthalate, polymethyl methacrylate and polycarbonate.

Besides these materials, non-sized paper or coat paper, which is properly sized paper, or a sheet-like material (for example, synthetic paper) made of a film opacified by filling an inorganic material or by minute bubbling may also be used. A sheet made of glass or metal may also be used. In order to improve adhesive strength between such a substrate and an ink receiving layer, the surface of the substrate may be subjected to a corona discharge treatment or various kinds of undercoating treatments.

EXAMPLES

The present invention will hereinafter be described in more detail by Examples and Comparative Examples. However, the present invention is not limited to these examples.

Phosphorus Compound Used in the Examples

As the compound represented by the general formula (1), were used the following phosphorus Compounds 1 to 4:

(Phosphorus Compound 1)

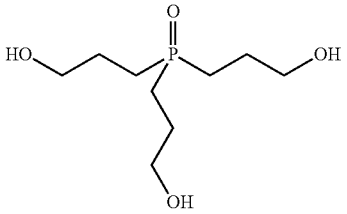

-continued (Phosphorus Compound 2)

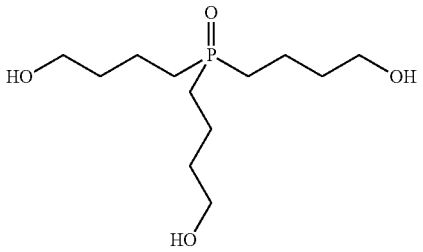

(Phosphorus Compound 3)

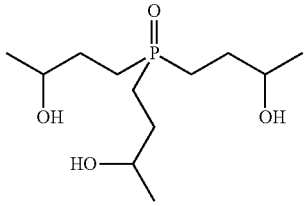

(Phosphorus Compound 4)

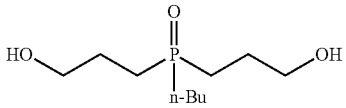

1. Preparation of Ink Jet Recording Medium Preparation of Substrate

A substrate was prepared in the following manner. A stock of the following composition was first prepared.

| | |
|---|---|
| Pulp slurry | 100 parts by mass |
| Laulholz bleached kraft pulp (LBKP) having a freeness of 450 ml CSF (Canadian Standard Freeness) | 80 parts by mass |
| Nadelholz bleached kraft pulp (NBKP) having a freeness of 450 ml CSF | 20 parts by mass |
| Cationized starch | 0.6 parts by mass |
| Heavy calcium carbonate | 10 parts by mass |
| Precipitated calcium carbonate | 15 parts by mass |
| Alkyl ketene dimer | 0.1 parts by mass |
| Cationic polyacrylamide | 0.03 parts by mass |

Paper making was conducted with this stock by means of a Fourdrinier paper machine, followed by 3-stage wet pressing and drying by means of a multi-cylinder dryer. The resultant paper was impregnated with an aqueous solution of oxidized starch by means of a size press so as to give a solid content of 1.0 g/m$^2$ followed by drying. Then the paper was finished through a machine calender to obtain Paper Substrate A having a basis weight of 170 g/m$^2$, a Stöckigt sizing degree of 100 seconds, an air permeability of 50 seconds, a Bekk smoothness of 30 seconds and a Gurley stiffness of 11.0 mN.

A resin composition composed of low density polyethylene (70 parts by mass), high density polyethylene (20 parts by mass) and titanium oxide (10 parts by mass) was then applied to a surface of Paper Substrate A, on which an ink receiving layer will be provided, in a proportion of 25 g/m$^2$. A resin composition composed of high density polyethylene (50 parts by mass) and low density polyethylene (50 parts by mass) was further applied to the other surface of the paper substrate A in a proportion of 25 g/m$^2$, thereby obtaining a substrate with both surfaces thereof coated with the resins.

Preparation of Fine Particle Dispersion 1

Alumina hydrate (DISPERAL HP14, product of Sasol Co.) as inorganic pigment particles was added into pure water so as to give a concentration of 23% by mass, thereby obtaining an aqueous solution of alumina hydrate. Acetic acid was then added to this aqueous solution of alumina hydrate such that (acetic acid)/(alumina hydrate)×100=2.0 in terms of solid content, and the resultant mixture was stirred to obtain Fine particle Dispersion 1.

Preparation of Fine Particle Dispersion 2

Silica by a vapor phase method (Aerosil 380, product of Nippon Aerosil Co., Ltd.) as inorganic pigment particles was added into pure water so as to give a concentration of 10% by mass. A dimethyldiallylammonium chloride homopolymer (SHALLOL DC902P, product of DAI-ICHI KOGYO SEIYAKU CO., LTD.) was then added such that (SHALLOL DC902P)/(silica)×100=4.0 in terms of solid content. Thereafter, the resultant mixture was dispersed with a high-pressure homogenizer to prepare Fine Particle Dispersion 2.

Example 1

Polyvinyl alcohol PVA 235 (product of Kuraray Co., Ltd.; polymerization degree: 3,500, saponification degree: 88%) was dissolved in ion-exchange water to obtain an aqueous solution of PVA having a solid content of 8.0% by mass. Phosphorus Compound 1 was added to Fine Particle Dispersion 1 prepared above such that (Phosphorus Compound 1)/(alumina hydrate)×100=0.1 in terms of solid content, and the resultant mixture was stirred. The PVA solution prepared above was further added and mixed such that (polyvinyl alcohol)/(alumina hydrate)×100=10 in terms of solid content, thereby obtaining a liquid mixture. A 3.0% by mass aqueous solution of boric acid was then added and mixed into the liquid mixture such that (boric acid)/(alumina hydrate)×100=1.7 in terms of solid content, thereby obtaining a coating liquid for ink receiving layers. The resultant coating liquid was then applied to the surface of the substrate by a die coater so as to give a dry coating amount of 35 g/m$^2$, thereby providing an ink receiving layer. In this manner, Ink Jet Recording Medium 1 was prepared.

Example 2

Ink Jet Recording Medium 2 was prepared in the same manner as in Example 1 except that Phosphorus Compound 1 was added such that (Phosphorus Compound 1)/(alumina hydrate)×100=1.

Example 3

Ink Jet Recording Medium 3 was prepared in the same manner as in Example 1 except that Phosphorus Compound 1 was added such that (Phosphorus Compound 1)/(alumina hydrate)×100=2.

Example 4

Ink Jet Recording Medium 4 was prepared in the same manner as in Example 1 except that Phosphorus Compound 1 was added such that (Phosphorus Compound 1)/(alumina hydrate)×100=4.

Example 5

Ink Jet Recording Medium 5 was prepared in the same manner as in Example 1 except that Phosphorus Compound 1 was added such that (Phosphorus Compound 1)/(alumina hydrate)×100=6.

Example 6

Ink Jet Recording Medium 6 was prepared in the same manner as in Example 1 except that Phosphorus Compound 1 was added such that (Phosphorus Compound 1)/(alumina hydrate)×100=10.

Example 7

Ink Jet Recording Medium 7 was prepared in the same manner as in Example 1 except that Phosphorus Compound 1 was added such that (Phosphorus Compound 1)/(alumina hydrate)×100=20.

Example 8

Ink Jet Recording Medium 8 was prepared in the same manner as in Example 1 except that Phosphorus Compound 1 was added such that (Phosphorus Compound 1)/(alumina hydrate)×100=25.

Example 9

Ink Jet Recording Medium 9 was prepared in the same manner as in Example 1 except that Phosphorus Compound 1 was added such that (Phosphorus Compound 1)/(alumina hydrate)×100=0.05.

Example 10

Ink Jet Recording Medium 10 was prepared in the same manner as in Example 4 except that Phosphorus Compound 1 was changed to Phosphorus Compound 2.

Example 11

Ink Jet Recording Medium 11 was prepared in the same manner as in Example 4 except that Phosphorus Compound 1 was changed to Phosphorus Compound 3.

Example 12

The PVA solution prepared above was mixed with Fine Particle Dispersion 1 prepared above such that (polyvinyl alcohol)/(alumina hydrate)×100=10 in terms of solid content, thereby obtaining a liquid mixture. A 3.0% by mass aqueous solution of boric acid was then added and mixed into the liquid mixture such that (boric acid)/(alumina hydrate)×100=1.7 in terms of solid content, thereby obtaining a coating liquid for ink receiving layers. The resultant coating liquid was then applied to the surface of the substrate by a die coater so as to give a dry coating amount of 35 g/m$^2$, thereby forming an ink receiving layer on the substrate.

A 5% methanol solution of Phosphorus Compound 1 was further applied on to this ink receiving layer by a Meyer bar such that (Phosphorus Compound 1)/(alumina hydrate)×100=4.0 in terms of solid content, thereby penetrating into the ink receiving layer. In this manner, Ink Jet Recording Medium 12 was prepared.

Example 13

Ink Jet Recording Medium 13 was prepared in the same manner as in Example 12 except that Phosphorus Compound 1 was changed to Phosphorus Compound 4.

Example 14

Phosphorous Compound 1 was added to Fine Particle Dispersion 2 prepared above such that (Phosphorus Compound 1)/(silica)×100=4.0 in terms of solid content, and the resultant mixture was stirred. The aqueous PVA solution described in Example 1 was then added such that (polyvinyl alcohol)/(silica)×100=20 in terms of solid content, thereby obtaining a liquid mixture. A 3.0% by mass aqueous solution of boric acid was then mixed with the liquid mixture such that (boric acid)/(silica)×100=6.0 in terms of solid content, thereby obtaining a coating liquid for ink receiving layers. The resultant coating liquid was then applied to the surface of the same substrate as that used in Example 1 by the same method as in Example 1 so as to give a dry coating amount of 25 g/m$^2$, thereby obtaining Ink Jet Recording Medium 14.

Example 15

The aqueous PVA solution described in Example 1 was added to Fine Particle Dispersion 2 prepared above such that (polyvinyl alcohol)/(silica)×100=20 in terms of solid content, thereby obtaining a liquid mixture. A 3.0% by mass aqueous solution of boric acid was then added and mixed into the liquid mixture such that (boric acid)/(silica)×100=6.0 in terms of solid content, thereby obtaining a coating liquid for ink receiving layer. The resultant coating liquid was then applied to the surface of the same substrate as that used in Example 1 by the same method as in Example 1 so as to give a dry coating amount of 25 g/m$^2$, thereby forming an ink receiving layer on the substrate.

A 5% methanol solution of Phosphorus Compound 1 was further applied on to this ink receiving layer by a Meyer bar such that (Phosphorus Compound 1)/(silica)×100=4.0 in terms of solid content, thereby penetrating into the ink receiving layer. In this manner, Ink Jet Recording Medium 15 was prepared.

Example 16

Ink Jet Recording Medium 16 was prepared in the same manner as in Example 14 except that Phosphorus Compound 1 was changed to Phosphorus Compound 2.

The following phosphorus Compounds 5 to 7 were used as compounds used in Comparative Examples.

Phosphorus Compound 5

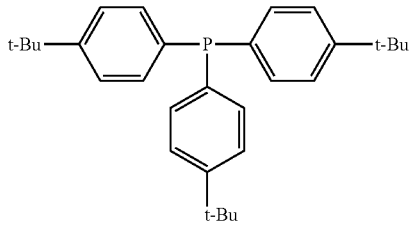

Phosphorus Compound 6

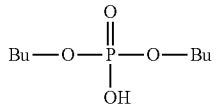

Phosphorus Compound 7

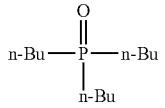

Comparative Example 1

The aqueous PVA solution prepared above was added to Fine Particle Dispersion 1 prepared above such that (polyvinyl alcohol)/(alumina hydrate)×100=10 in terms of solid content, thereby obtaining a liquid mixture. A 3.0% by mass aqueous solution of boric acid was then mixed with the liquid mixture such that (boric acid)/(alumina hydrate)×100=1.7 in terms of solid content, thereby obtaining a coating liquid for ink receiving layers. The resultant coating liquid was then applied on to the surface of the substrate with both surfaces thereof coated with the resins by a die coater so as to give a dry coating amount of 35 g/m$^2$, thereby preparing Ink Jet Recording Medium 17. This comparative Example is an example where no phosphorus compound is contained in the ink receiving layer.

Comparative Example 2

Ink Jet Recording Medium 18 was prepared in the same manner as in Example 10 except that Phosphorus Compound 1 was changed to Phosphorus Compound 5, and methanol was changed to MIBK (methyl isobutyl ketone).

Comparative Example 3

Ink Jet Recording Medium 19 was prepared in the same manner as in Example 4 except that Phosphorus Compound 1 was changed to Phosphorus Compound 6.

Comparative Example 4

Phosphorus Compound 7 was added to Fine particle Dispersion 1 prepared above in the same manner as in Example 1 except that Phosphorus Compound 1 was changed to Phosphorus Compound 7, and the resultant mixture was stirred. However, Phosphorus Compound 7 was not dissolved to fail to obtain an uniform dispersion.

Comparative Example 5

Ink Jet Recording Medium 20 was prepared in the same manner as in Example 12 except that Phosphorus Compound 1 was changed to Phosphorus Compound 6, and methanol was changed to MIBK (methyl isobutyl ketone).

Comparative Example 6

The aqueous PVA solution described in Example 1 was added to Fine Particle Dispersion 2 prepared above such that (polyvinyl alcohol)/(silica)×100=20 in terms of solid content, thereby obtaining a liquid mixture. A 3.0% by mass aqueous solution of boric acid was then mixed with the liquid mixture such that (boric acid)/(silica)×100=6.0 in terms of solid content, thereby obtaining a coating liquid for ink receiving layers. The resultant coating liquid was then applied to the same substrate as that used in Example 1 by the same method as in Example 1 so as to give a dry coating amount of 25 g/m$^2$, thereby preparing Ink Jet Recording Medium 21.

Comparative Example 7

Ink Jet Recording Medium 22 was prepared in the same manner as in Example 12 except that Phosphorus Compound 1 was changed to Phosphorus Compound 6.

Comparative Example 8

Ink Jet Recording Medium 23 was prepared in the same manner as in Example 15 except that Phosphorus Compound 1 was changed to Phosphorus Compound 6, and methanol was changed to MIBK (methyl isobutyl ketone).

Comparative Example 9

Ink Jet Recording Medium 24 was prepared in the same manner as in Example 12 except that Phosphorus Compound 1 was changed to Phosphorus Compound 7.

2. Evaluation of Ink Jet Recording Medium

Ink Jet Recording Media 1 to 24 prepared in Examples 1 to 16 and Comparative Examples 1 to 9 were used to make evaluation as to weatherability (light fastness, ozone fastness) of recorded articles and ink absorbency (uniformity) according to the following respective methods and criteria. Evaluation results are shown in Table 1.

Preparation of Recorded Article

PIXUS iP8600 (ink: BCI-7, manufactured by Canon Inc.) was used as an ink jet recording apparatus. Respective single-color patches of black, cyan, magenta and yellow were printed on the recording surfaces of Ink Jet Recording Media 1 to 24 by the ink jet recording apparatus such that the optical densities (O.D.) thereof were respectively 1.0, thereby preparing recorded articles.

Light Fastness

The above-described recorded articles were subjected to a xenon exposure test by means of Xenon Weatherometer (XL-75C Model, manufactured by Suga Test Instruments Co., Ltd.).

Testing Conditions:

Accumulated irradiation: 40000 klux·hr

Temperature and humidity conditions in testing chamber: 23° C. and 50% RH.•Evaluating method of light fastness:

Optical densities of the above-described recorded articles before and after the test were measured by means of a spectrophotometer (trade name: Spectro Lino; manufactured by Gretag Macbeth Co.) to determine density retention according to the following equation, thereby evaluating the light fastness according to the following evaluation criteria.

Density retention (%)=(Optical density after test/Optical density before test)×100.

Evaluation Criteria

A: Density retention of yellow is 85% or more;

B: Density retention of yellow is 80% or more and less then 85%;

C: Density retention of yellow is 70% or more and less then 80%;

D: Density retention of yellow is less than 70%.

Ozone Fastness

An ozone exposure test was conducted by means of Ozone Weatherometer (OMS-HS Model, manufactured by Suga Test Instruments Co., Ltd.).

Testing Conditions:

Exposing gas composition: ozone 10 ppm

Testing time: 8 hours

Temperature and humidity conditions in testing chamber: 23° C. and 50% RH.

Evaluating Method of Ozone Fastness:

The L* values, a* values and b* values before and after the test of the same recorded articles as those used in the light fastness test were measured by means of a spectrophotometer (trade name: Spectro Lino; manufactured by Gretag Macbeth Co.) to determine ΔE according to the following equation, thereby evaluating the ozone fastness according to the following evaluation criteria.

$$\Delta E=\{([L^*\text{value of a recorded article before test}]-[L^*\text{value of the recorded article after test}])^2+([a^*\text{value of the recorded article before test}]-[a^*\text{value of the recorded article after test}])^2+([b^*\text{value of the recorded article before test}]-[b^*\text{value of the recorded article after test}])^2\}^{1/2}.$$

Evaluation Criteria

A: The largest value among the ΔE values of the respective single-color patches of black, cyan, magenta and yellow is less than 5;

B: The largest value among the ΔE values of the respective single-color patches of black, cyan, magenta and yellow is 5 or more and less than 10;

C: The largest value among the ΔE values of the respective single-color patches of black, cyan, magenta and yellow is 10 or more and less than 20.

D: The largest value among the ΔE values of the respective single-color patches of black, cyan, magenta and yellow is 20 or more.

<Ink Absorbency>

(Preparation of Recorded Article)

PIXUS iP8600 (ink: BCI-7, manufactured by Canon Inc.) was used as an ink jet recording apparatus. Patches of 8 intermediate color gradations from cyan monochrome to magenta monochrome were respectively printed on the recording surfaces of Ink Jet Recording Media 1 to 24 by means of the ink jet recording apparatus, thereby producing recorded articles.

With respect to the recorded articles, the image quality thereof was visually observed, thereby evaluating the ink absorbency according to the following evaluation criteria.

Evaluation Criteria

A: The penetration of the inks in the image in the patch is very uniform, and no density unevenness is observed;

B: The penetration of the inks in the image in the patch is uniform, and almost no density unevenness is observed;

C: The penetration of the inks in the image in the patch is varied, and density unevenness is observed;

D: The penetration of the inks in the image in the patch is considerably varied, and density unevenness is conspicuous.

TABLE 1

| | Phosphorus Compound | | Evaluating test | | |
|---|---|---|---|---|---|
| | Kind | Content | Ozone fastness | Light fastness | Ink absorbency |
| Ex. 1 | 1 | 0.1 | B | B | A |
| Ex. 2 | 1 | 1.0 | B | B | A |
| Ex. 3 | 1 | 2.0 | B | B | A |
| Ex. 4 | 1 | 4.0 | B | A | A |
| Ex. 5 | 1 | 6.0 | B | A | A |
| Ex. 6 | 1 | 10.0 | B | A | B |
| Ex. 7 | 1 | 20.0 | B | A | B |
| Ex. 8 | 1 | 25.0 | A | A | C |
| Ex. 9 | 1 | 0.05 | C | C | A |
| Ex. 10 | 2 | 4.0 | B | A | A |
| Ex. 11 | 3 | 4.0 | B | A | A |
| Ex. 12 | 1 | 4.0 | B | A | B |
| Ex. 13 | 4 | 4.0 | B | A | B |
| Ex. 14 | 1 | 4.0 | B | A | A |
| Ex. 15 | 1 | 4.0 | B | A | B |
| Ex. 16 | 2 | 4.0 | B | A | B |
| Comp. Ex. 1 | — | — | D | D | D |
| Comp. Ex. 2 | 5 | 4.0 | D | D | D |
| Comp. Ex. 3 | 6 | 4.0 | C | C | D |
| Comp. Ex. 4 | 7 | 4.0 | — | — | — |

TABLE 1-continued

| | Phosphorus Compound | | Evaluating test | | |
|---|---|---|---|---|---|
| | Kind | Content | Ozone fastness | Light fastness | Ink absorbency |
| Comp. Ex. 5 | 6 | 4.0 | C | C | D |
| Comp. Ex. 6 | — | — | C | C | D |
| Comp. Ex. 7 | 6 | 4.0 | C | C | D |
| Comp. Ex. 8 | 6 | 4.0 | C | C | D |
| Comp. Ex. 9 | 7 | 4.0 | C | C | D |

When the results of Example 1 to 16 and Comparative Examples 1 to 9 are compared, it is understood that the ink jet recording media containing the compound represented by the general formula (1) is excellent in all of the ozone fastness, light fastness and ink absorbency.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-163644, filed Jun. 23, 2008, which is hereby incorporated by reference herein in its entirety.

The invention claimed is:

1. An ink jet recording medium comprising a substrate and an ink receiving layer provided on at least one surface of the substrate, wherein the ink receiving layer comprises a compound represented by the following general formula (1):

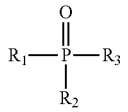

(1)

wherein $R_1$, $R_2$ and $R_3$ are individually a linear or branched alkyl group having 1 to 20 carbon atoms, with the proviso that at least one of $R_1$, $R_2$ and $R_3$ has a hydroxyl group, wherein the ink receiving layer further comprises (a) a pigment and (b) polyvinyl alcohol, and wherein where the content of the compound represented by the general formula (1) is A parts by mass in terms of solid content and the content of the pigment is B parts by mass in terms of solid content, A/B satisfies the relationship $1 \leqq (A/B) \times 100 \leqq 20.0$.

2. The ink jet recording medium according to claim 1, wherein the pigment is alumina hydrate.

3. The ink jet recording medium according to claim 1, wherein the ink receiving layer further comprises a water-soluble resin.

* * * * *